United States Patent [19]

Glenn

[11] 4,073,278

[45] Feb. 14, 1978

[54] CARBURATOR

[76] Inventor: Edward R. Glenn, 2300 Laurel, Newport Beach, Calif. 92660

[21] Appl. No.: 649,869

[22] Filed: Jan. 16, 1976

[51] Int. Cl.[2] ..... F02D 13/06

[52] U.S. Cl. ..... 123/198 F; 261/23 A; 261/47

[58] Field of Search ..... 123/198 F, 97 R, 127, 123/59 PC; 261/23 A, 47

[56] References Cited

U.S. PATENT DOCUMENTS

| | | | |
|---|---|---|---|
| 2,085,818 | 7/1937 | Messinger | 123/198 F |
| 2,114,655 | 4/1938 | Leibing | 123/198 F |
| 2,186,043 | 1/1940 | Rohlin | 123/198 F |
| 2,623,617 | 12/1952 | Snyder | 123/198 F X |
| 3,578,116 | 5/1971 | Nakayima et al. | 123/198 F X |
| 3,765,394 | 10/1973 | Francis | 123/198 F |

*Primary Examiner*—Charles J. Myhre

*Assistant Examiner*—Ira S. Lazarus

*Attorney, Agent, or Firm*—George A. Maxwell

[57] ABSTRACT

A carburator for use in combination with an intake manifold for a multi-cylinder internal combustion engine wherein the manifold has two sets of related tunnels to conduct fuel and air to related sets of cylinders, said carburator having two venturi throats, each related to one set of tunnels, throttle valves in the throats, an air conducting throat related to one set of tunnels, a shut-off valve in the air conducting throat related to one set of tunnels, a shut-off valve in the air conducting throat and means operable to selectively open and close the shut-off valve and to maintain the throttle valve related to said one set of tunnels closed when the shut-off valve is open, whereby the engine can be selectively operated on all cylinders or on only those cylinders with which the shut-off valve is not related.

6 Claims, 6 Drawing Figures

CARBURATOR

This invention has to do with carburation means for multi-cylinder internal combustion engines and is more particularly concerned with means for selectively delivering fuel and air to all or to a number of cylinders less than the total number of cylinders of a related internal combustion engine.

It is an object and feature of the present invention to provide novel carburation means for an eight cylinder internal combustion engine which is operable to selectively deliver a combustible mixture of fuel and air to all eight cylinders or to deliver such a mixture of fuel and air to only four of the cylinders and deliver air alone to the other four of the cylinders.

In the ordinary or conventional eight cylinder automobile engine, delivery of the combustible mixture of fuel and air to the several cylinders is effected by a carburator which operates to mix the necessary fuel and air together and by an intake manifold which conducts the mixture of fuel and air to the several cylinders of the engine. The flow of the mixture into the cylinders is regulated or controlled by mechanically operated intake valves in the intake ports of the engine establishing communication between the cylinders and the intake manifold.

In practice, in the conventional eight cylinder engine, the intake manifold comprises two sets of related tunnels, the tunnels of each set of tunnels communicating with one-half of the cylinders, in alternating firing order and each of which communicates with and is supplied with the necessary fuel and air mixture from an independent venturi or throat of a related carburator.

Still further, in practice, two basic types or forms of carburators are provided for eight cylinder engines. One of said types of carburators is a two barrel unit providing a single venturi throat for each section or set of tunnels of the intake manifold. Two barrel carburators are most economical of fuel and afford moderate engine performance. The other type of carburator is a four barrel unit providing a pair of venturi throats for each section of the manifold, one of which venturi throats commonly referred to as the "low speed throat" is operable continuously for idle, low speed and moderate engine operation and the other of which is selectively put into operation for acceleration and high speed operation and is commonly referred to as the "high speed throat". The low speed throats of such carburators are provided with fuel delivery nozzles or jets of limited flow capacity in the upper high velocity portions of the vertically extending open ended venturi sections of said throats, a normally open clapper type choke valve overles the upper ends of said throats and is under control of appropriate actuating means, butterfly type throttle valves are in the lower end portions of the throats, and fuel delivery idling nozzles or jets are in the throats below the throttle valves.

The high speed throats are large diameter passages with high volume nozzles or jets communicating with the upper portions thereof and have butterfly type throttle valves in their lower portions. The throttle valves in the two low speed throats of a four barrel carburator are generally on a common shaft and are opened and closed synchronously by related manually or foot controlled throttle linkage. The throttle valves in the high speed throats of such carburators are connected with the throttle linkage noted above by suitable lost motion link and/or lever means whereby those valves only open when the linkage is actuated rapidly and/or when said linkage is actuated in some predetermined major extent.

The ordinary or conventional four barrel carburator construction is a sectional construction including a central die cast section defining the principal or major portion of the four venturi throats, the bottom and side walls of float chambers in which fuel is stored and in or through which fuel conducting passages, for conducting fuel from said chambers to the jets are established. Such carburators next include a top section which overlies and closes the tops of the chambers and which defines the upper mouth end portion of the several venturi throats. The upper section supports and/or carries the choke valve member of the choke means and is characteristically provided with means to cooperatively engage and support an air cleaner. The ordinary carburator next and finally includes a lower, flat, plate-like throttle valve section which engages with and overlies the upper inlet end of a related intake manifold and which is secured to and overlies the lower end or bottom of the central section. The throttle valve plate or section has vertical through ports communicating with the four throats in the central section and in which butterfly type throttle valve members are pivotally supported. The throttle valve plates carry the idle fuel jets which jets communicate with the two low speed throats, below the throttle valves therein. The idle jets are supplied with fuel by means of passages in the plate which passages communicate with the passages in the central section of the carburator. The flow of fuel to the idle jets is controlled by suitable manually adjustable needle valve means.

The above noted and briefly described basic carburator construction is subject to exception. For example, the central and lower sections are often integrally formed in one piece. In spite of such exceptions, the basic relationship of parts and/or portions remains essentially the same and the noted sections can be readily defined as distinct portions in those structures in which they are integrated. In operation, when an engine related to a carburator of the character referred to above is operating at idle, the throttle valves are in a substantially closed, normal position. When in such a position, the necessary flow of air to sustain such idle operation is leaked by the throttle valves and the necessary fuel for such operation is drawn through and from the idle jets.

As and when the speed of the engine is increased, the throttle valves in the low speed throats are open, admitting more air and creating increased draft in and through the low speed throats which draws necessary additional fuel through and from the low speed jets. The low speed throats, valves and jets are suitable for controlling a wide range of operating engine speeds and are effective when the valves are fully open to effect reasonable normal acceleration requirements.

In further operation of the engine with which the above described carburator structure is related, upon demand and when high speed performance or greater than normal acceleration is required, the throttle valves related to the high speed throats are open, admitting a greatly increased flow of air to the engine and, by virtue of that flow of air by the high speed jets, a proportionately greater volume of fuel.

In practice, most carburators, in addition to the basic structure noted above, include accelerator pump means or dash pots, the function of which is to urge and force an added volume or surge of fuel through the jets when the throttle valves are opened rapidly and to thereby assure the presence of adequate fuel and quick engine response.

Theoretically, if the two throttle valves of a two barrel carburator related to an eight cylinder engine were independently operable, one could open the valve in one barrel or throat of the carburator and leave the valve in the other throat of the carburator closed. As a result of such operation of the carburator, the engine would be caused to operate on but four of its eight cylinders. While the above might be accomplished, the results would be less than desirable since the air supply to the four cylinders placed out of service or not supplied with fuel and air, would be shut off. As a result of the above, and as the pistons in the out of service cylinders continue to reciprocate therein, they would, on their intake strokes, draw a vacuum in the cylinders. The energy required and spent to draw such vacuum or minus pressures in the cylinders would be substantial and the vacuum or minus pressures thus established would tend to pump or draw crankcase oil by the pistons into the cylinders. Such oil in the cylinders would foul the spark plugs and would tend to foul the piston rings. Further, such pumping and moving of crankcase oil would result in pumping the oil out of the engine and into the exhaust system thereof.

In order to attain the effective operation of an eight cylinder engine on but four cylinders in the manner suggested above, but without the noted adverse effects, it would be necessary to provide for the free flow of air to the cylinders taken out of service, during the intake strokes of the pistons therein, whereby the pistons would be free to move, without loss of appreciable energy and so that no vacuum or minus pressure, which would result in the pumping of crankcase oil into and through the cylinders, as above noted, would be generated or be encountered.

An object and feature of my invention is to provide a novel two barrel carburator for an eight cylinder engine with novel throttle valves and throttle valve control means whereby one or both of the throttle valves can be selectively moved from their normal closed positions to open positions and which includes normally closed air valve means adapted to open and afford free flow of air into the four cylinders normally supplied with fuel and air by one throat of the carburator when the throttle valve in that throat is closed and the throttle valve in the other throat of the carburator and supplying fuel and air to the other cylinders of the engine is open, whereby mixed fuel and air is selectively conducted to all eight or to but four of the eight cylinders of the engine and air is conducted to four cylinders of the engine not supplied with mixed fuel and air when but four of the air cylinders are supplied with mixed fuel and air.

There is little likelihood that manufacturers of automobiles would provide carburator structures with the above noted capability of my invention and there is every likelihood that such manufacturers would adhere to the concept that since automobiles with four, six and eight cylinder engines are available, one can and should select an automobile with the kind and size of engine he desires and that the option of selectively operating an eight cylinder engine on all eight or but four of its cylinders is not sufficiently desirable to disturb the existing market techniques and practices.

Further, and for related and/or similar reasons, it is not likely that carburator manufacturers would manufacture special carburators with the above noted capabilities.

In light of the above, it is an object and feature of my invention to provide a novel lower throttle valve plate section or unit for a standard four barrel carburator which is such that it can be easily and quickly substituted for the standard or original lower throttle valve plate section or unit of the carburator and which modifies the operation of that carburator to that of a two barrel carburator with selectively operable throttle valve means and with a valve control air supply means related to one barrel and to the engine cylinders related thereto.

It is an object and feature of my invention to provide a novel structure and means of the character referred to above, including novel throttle and air valve actuating means.

Yet another object of the present invention is to provide novel means of the general character referred to above which are easy and economical to manufacture and to install and which are highly effective and dependable in operation.

A basic object and feature of the present invention is to provide novel carburator means of the character referred to which is such that a related automobile engine can be effectively and efficiently operated on half of its cylinders when developed engine power requirements permit and which is such that the engine can be made to operate on all of its cylinders when developed engine power output requirements exceed the output power of but half of the engine's cylinders.

It is therefore and object and feature of the present invention to provide a means which is operable and effective to result in a considerable savings in fuel in the normal operation of an automobile engine and yet retain the immediate availability of that degree of high power output by the engine which is considered desirable and is intermittently demanded, but which is wasteful of fuel.

The foregoing and other objects and features of my invention will be fully understood from the following detailed description of a typical preferred form and application of my invention throughout which description reference is made to the accompanying drawings in which.

Figure 1:
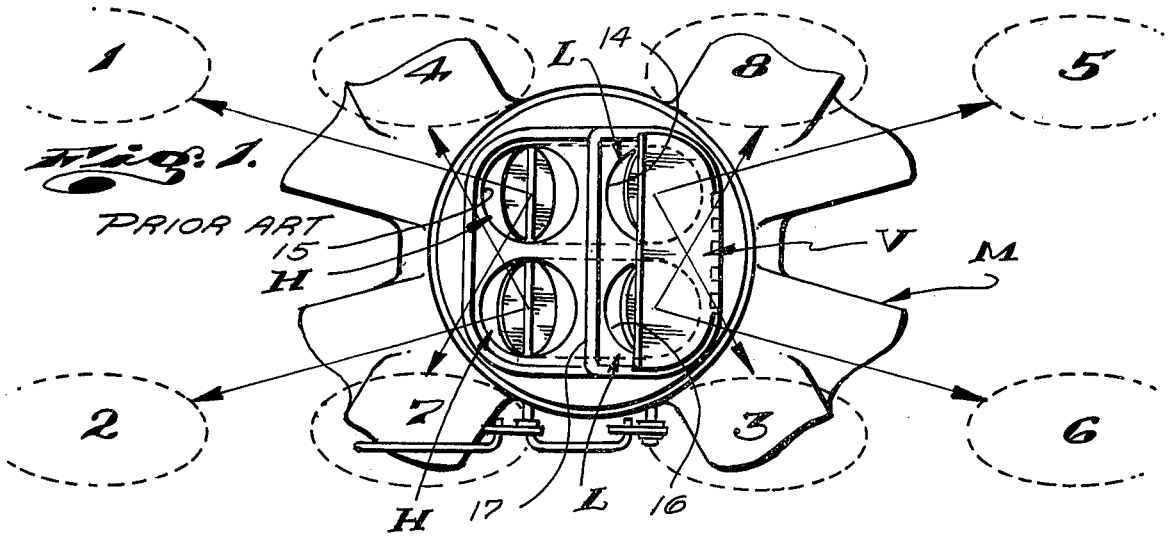
Fig. 1. PRIOR ART
FIG. 1 is a diagrammatic view of a carburation means provided by the prior art.

In FIG. 1 I have shown a diagrammatic plan view of a four barrel carburator A, as provided by the prior art, and have shown the carburator related to a portion of an intake manifold M. I have diagrammatically indicated the cylinders (phanton lines) of a related eight cylinder engine which are served by the throats of the carburator, by means of arrows extending from the throats to the cylinders served thereby. The cylinders are numbered in accordance with their firing order.

As shown in FIG. 1, the two upper throats (left and right) of the carburator serve cylinders 1, 3, 5 and 7 and the two lower throats (left and right) serve cylinders 2, 4, 6 and 8. The noted two upper throats are related to each other and the two lower throats are related to each other. The right hand throats, of the noted related pairs of throats are low speed throats which remain functional at all times, that is, when the engine is operating at idle, medium or high speeds.

The low speed throats are those throats with which the choke valve means V is related. The left hand throats of the pairs of throats are high speed throats and are only operational upon demand and when additional air and fuel are required for desired engine performance or response.

Figure 2:
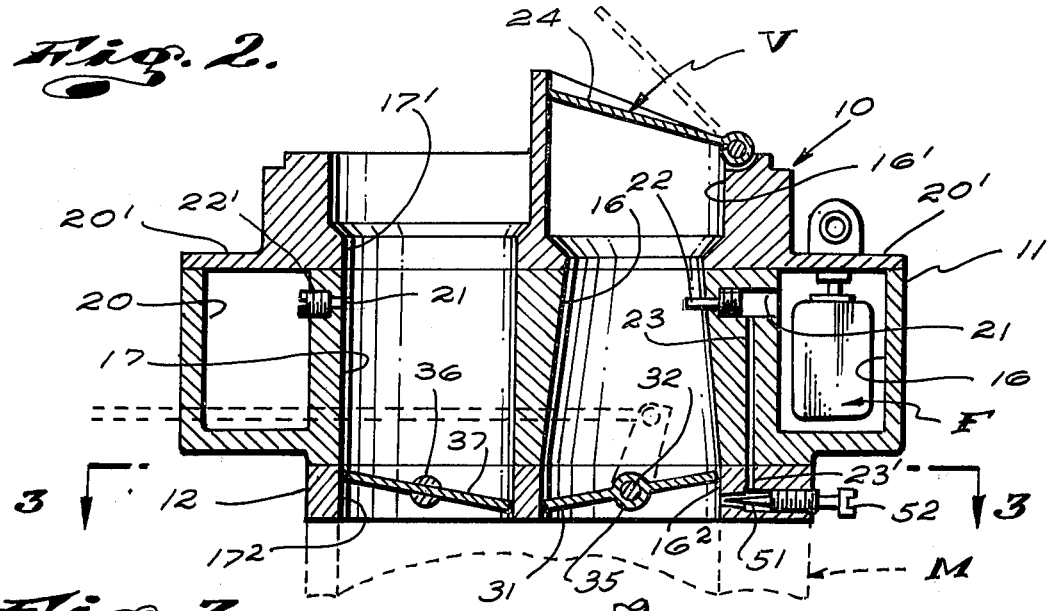
FIG. 2 is a detailed sectional view of my invention.
Figure 3:
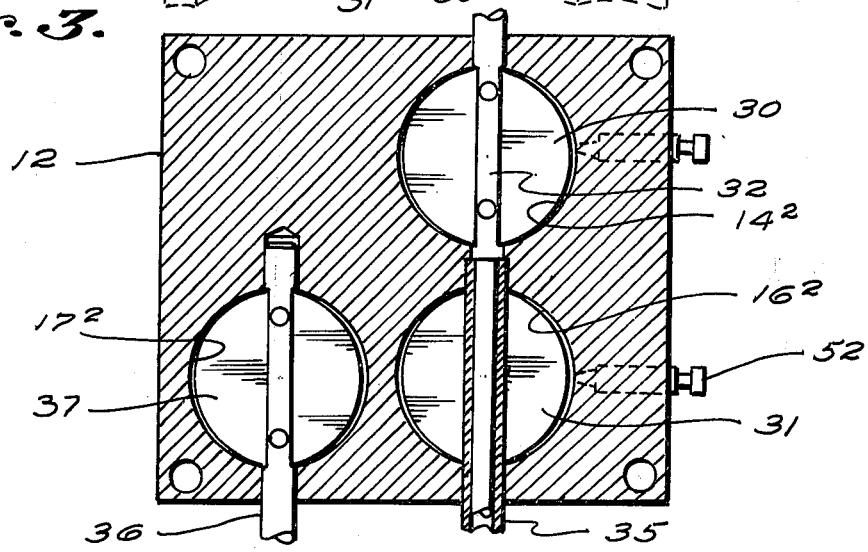
FIG. 3 is a view taken substantiall as indicated by line 3—3 and showing parts in one position.

In FIG. 2 of the drawings, I have shown a carburator C embodying my invention and which includes an upper section 10, an intermediate section 11 and a lower section 12. The upper and intermediate sections 10 and 11 are or can be the upper and intermediate sections of a standard or conventional four barrel carburator such as shown in FIG. 1 of the drawings and briefly described above.

The lower section 12 is a special unit or part which replaces a similar portion or part of a conventional four barrel carburator construction.

The central section 11 is the barrel or throat section of the carburator and establishes the major portions of the vertically extending open ended venturi throats 14, 15, 16 and 17. The throats 14 and 16 are low speed throats and the throats 15 and 17 are high speed throats. The throats 15 and 17 are related to the throats 14 and 16, respectively.

The section 11 has or defines float chambers 20 at its left and right hand sides to maintain volumes of fuel for the high and low speed throats and is provided with fuel conducting passages 21 between the chambers and throats and in which nozzles or jets 22 are engaged. The jets 22 project into and communicate with the throats and are adapted to dispense metered volumes of fuel into the throats. The fuel is drawn through the jets by minus pressures generated in the throats by the air flowing downwardly therethrough. The level of fuel in the chambers 20 is controlled by suitable float valve means F in said chambers.

In carrying out my invention, the high speed throat 15 is taken out of service and the operation and/or service of the high speed throat 17 is modified so that no fuel is conducted therethrough. Accordingly, the chamber 20 related to the high speed throats is taken out of service and the float valve means normally related thereto can, as indicated, be removed.

The jets normally related to the high speed throats can be removed and can, as shown, be replaced by suitable plugs 22'.

Finally, in addition to the foregoing, the section 11 is provided with vertically extending idle fuel supply passages 23, which passages extend from the passages 21 for the low speed jets to the bottom of the section 11 to open at or adjacent the section 12, as will hereinafter be described.

The top section 10 of the carburator C is a cover section overlying the section 11. The section 10 has upper mouth openings or apertures 14', 15', 16' and 17' for the throats 14, 15, 16 and 17 of the section 11. The section 10 is further provided with plate portions which overlie and close the open tops of the chambers 20, defined by the central section. The mouths 14' and 16' of the section 10 open or establish communication with each other in the upper portion of that section and establish a seat structure for the flapper valve member 24 of the choke valve means V.

The choke valve means V, while a necessary means for the effective operation of a related engine, does not affect or constitute a part of the present invention. Accordingly, further illustation and detailed description of the means V can and will be dispensed with.

The structure thus far described is shown in a diagrammatic manner and is intended to show or illustrate that basic or fundamental structure and/or relationship of parts which is to be found in most standard or conventional four barrel carburators.

In practice, the details of construction of the sections 10 and 11 and of those means directly related thereto can and do vary considerably. Such variations, however, do not affect the novelty and spirit of my invention.

The lower section 12 that I provide is a flat throttle valve plate unit or section which is substituted for and/or replaces the standard throttle valve plate which is normally related to the lower or bottom of the section 10 and with the intake of the related manifold M.

The standard throttle valve plate which my plate 12 replaces includes, basically, four vertical through openings or valve ports which register with the throats in the central section 11 and with related upper inlet ends of the tunnels of the related manifold M. The standard throttle valve plate is provided with a butterfly type throttle valve in each port. The two valves related to the low speed throats are fixed to or carried by a common shaft and are operated synchronously by a suitable manually operable link and lever means at one end of the shaft and at the exterior of the plate. The two valve members related to the high speed throats are carried by a common shaft and are operated synchronously by means of link and lever means at one end of the shaft, which means is related to the manually operable link and lever means for the valve members related to the low speed throats and is such that the valve members in the high speed throats only open or are operated when the manually operable link and lever means is operated to some predetermined major extent.

The standard throttle valve plate and its operation, briefly described above, is well known to those skilled in the art.

The throttle valve plate 12 that I provide differs from the noted standard form of plate in that it has but two fuel and air conducting ports $14^2$ and $16^2$, which ports are related to and constitute continuations of the two low speed throats 14 and 16 in the central section 11. The plate 12 has, in addition to the ports $14^2$ and $16^2$ and air port $17^2$ related to the high speed throat 17 of the section 11 and with the inlet end of the manifold tunnels served by the throat 16 of the carburator.

With the plate 12, it will be apparent that the high speed throat 15 in the section 11 is blanked off or sealed and is put out of operation. Further, the tunnels of the manifold M related to the throats 14 and 16, serving to conduct fuel and air to the cylinders 1, 3, 5 and 7, are served only by the low speed throat 14.

The ports $14^2$, $16^2$ and $17^2$ in the plate 12 are provided with or accommodate butterfly type valve members 30, 31 and 37, respectively. The valves 30 and 31 are throttle valves and the valve 32 is an air or shut-off valve.

The valve 30 is carried by a shaft 32 extending transversely through the plate and through the ports $14^2$ and $16^2$. A manually operable link and lever type throttle valve operating means O is connected with one end of the shaft 32 at the exterior of the plate. The means O is preferably the standard throttle valve operating means provided for the engine with which my invention is related.

It is to be noted that the valve 30 is operational at all times and that cylinders 1, 3, 5 and 7 of the engine which are served thereby are operational at all times.

The valve 31 is carried by a tubular or sleeve shaft 35 rotatably engaged about the portion of the shaft 33 extending through the port $16^2$ and has an outer end projecting laterally outwardly from the side of the plate adjacent to the port $16^2$. The shaft 32 extends through and has a free end projecting outwardly and freely from the outer end of the shaft 35.

It will be apparent from the foregoing that the valves 30 and 31 are independently operable and that the valve 31 does not necessarily operate synchronously with the valve 30 as do the equivalent valves in the standard carburators.

The valve 37 is carried by a shaft 36 rotatably carried by the plate. The shaft 36 extends through the port $17^2$ and has an outer end portion projecting laterally from the side of the plate from which the shaft 35 projects. The shaft 36 is selectively operable between open and closed positions and is under control of a manually operable link and lever type selector means S. The selector means S related to the shaft 36 is also related to the shafts 32 and 35 and is operable to selectively shift the shafts 32 and 35 whereby the valve 31 can be operated synchonously with the valve 30 upon operation of the valve 30 by the means O. Otherwise stated, the means S is opeable to selectively establish an interrupt driving connection between the shafts 32 and 35 and making or breaking of drive between the means O and the valve 31, whereby the valve 31 can be selectively operated by the means O, synchronously with the valve 30 or can be disconnected or disassociated from the means O.

The means S is further operable to close the valve 37 and to disconnect or isolate the valve 31 from the means O and to close the valve 31 when the valve 37 is open.

The means S includes lever arms 40 and 41 on the outer ends of the shafts 35 and 36, an elongate drive rod 42 with front and rear ends extending parallel with the side of the plate from which the shafts 35 and 36 project. The rod 42 has a rear end portion that is pivotally and drivingly coupled with the lever arm 41 and a forward portion extending from the arm 41 by the arm 40, in close proximity thereto.

The front end of the rod 42 can be supported and guided by a support arm 43 pivotally carried by the plate and pivotally coupled with the rod, as clearly shown in the drawings.

The rod 42 carries a stop 44 which occurs forward of the arm 40 on the shaft 35. The arm 40 has a stop engaging pad 45 at its outer end which pad projects into interferring position with the stop 44 on the rod. The outer free end of the shaft 32 related to the outer end of the shaft 35 carries an arm 46. A spring means 47 is engaged between and with the arms 40 and 46. The spring means 47 serves to normally establish yielding driving engagement between the shafts 32 and 35 with resulting synchronous operation of the throttle valves 30 and 31, under control of the means O.

Figure 4:
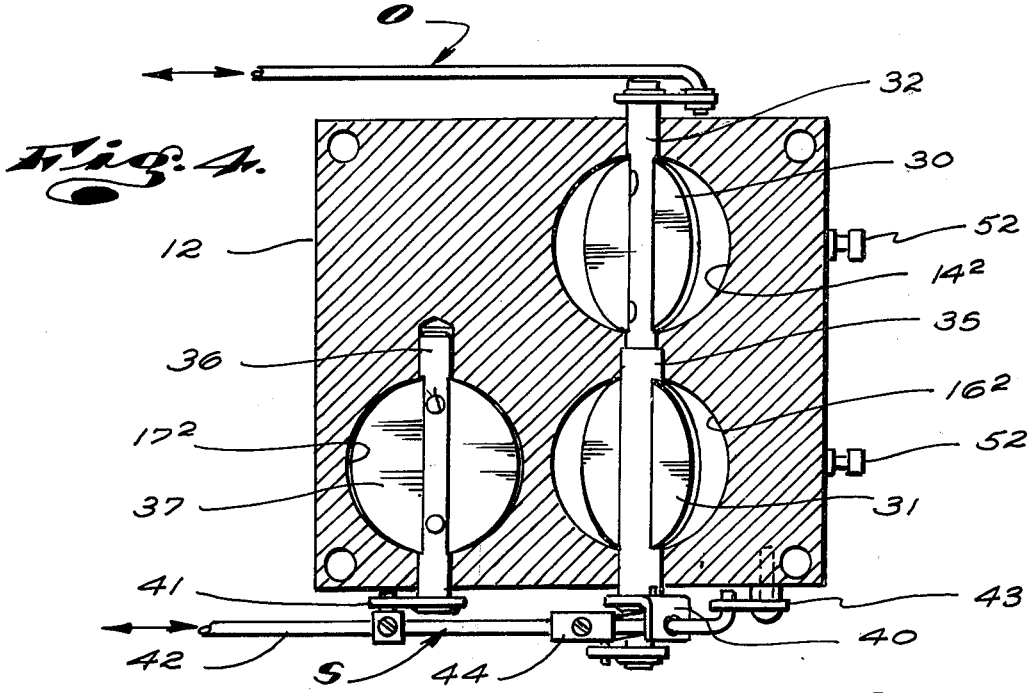
FIG. 4 is a view similar to FIG. 3 with parts in another position.
Figure 5:
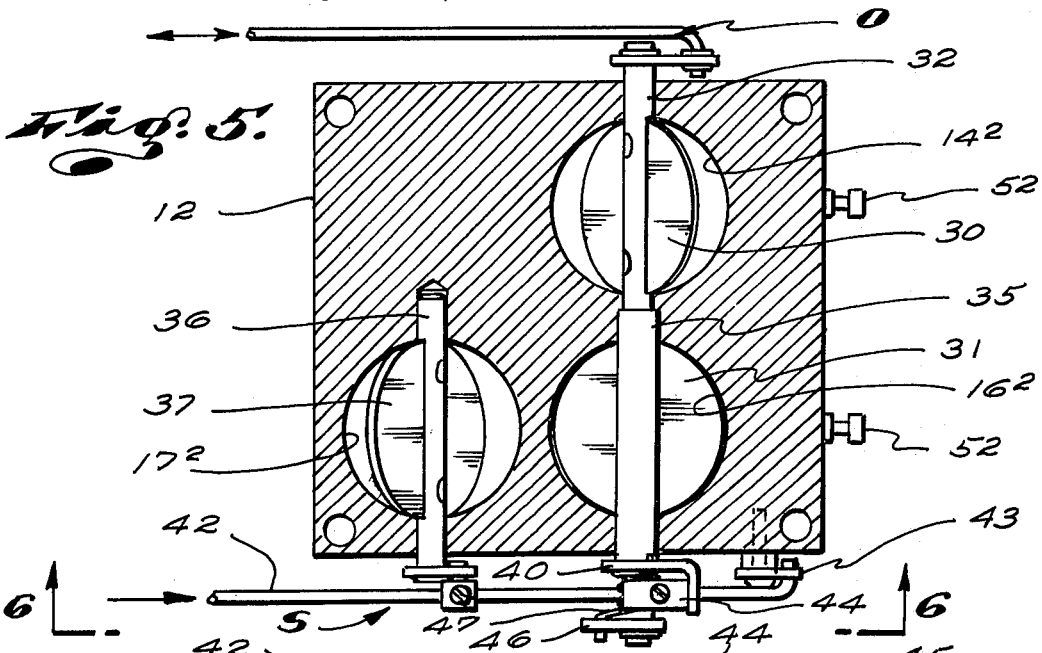
FIG. 5 is a view similar to FIG. 4 with parts in another position.
Figure 6:
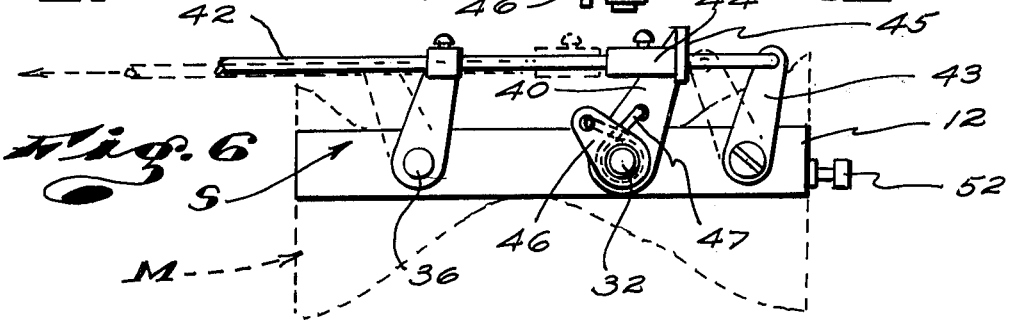
FIG. 6 is a view taken substantially as indicated by line 6—6 of FIG. 5.

The rod 42 is shiftable longitudinally forwardly from a normal rear position where the stop 44 is clear of and spaced from the pad 45 and where the spring means 47 establishes a yielding driving coupling between the arms 40 and 46, as shown in FIG. 4 of the drawings, to a forward position where the stop 44 engages the pad 45 and effects rotation of the shaft 35, closing of the valve 31, against the resistance of the spring means 47, as shown in FIG. 5 of the drawings.

The rod and valve 37 are related so that when the rod is in its normal rear position, as shown in FIG. 4 of the drawings, the valve 32 is closed and when the rod is in its forward position, as shown in FIG. 5 of the drawings, the valve 32 is open.

In light of the above, it will be apparent that the valve 37 is normally closed and the valves 30 and 31 are normally operable synchronously. Further, when the valve 37 is open, the valve 31 is urged and maintained closed and the valve 30 then, alone, remains operational.

The rear end of the rod 42 can be coupled with any suitable manually accessible means to effect shifting of the rod to and from its forward and rear positions. In practice, a suitable automatic means can be provided to shift the rod, which means can, for example, be responsive to operation and positioning of the means O and/or to the intake manifold pressures of the engine.

The spring means 47 can vary widely in practice. For example, and as shown in the drawings, the means 47 can be a simple, rat-trap type of torsion spring engaged about the shaft 32 between the arms 40 and 46 and having ends engaged in suitable apertures in the arms.

It is to be noted that the strength of the spring is such that when it is biased, as when the valve 37 is open and the valve 31 is closed, it is not so strong as to adversely affect operation of the means O and of the valve 30.

In addition to the foregoing and in accordance with common practice, the valve plate 12 is provided with idling nozzles or jets 50 communicating with the lower ends of the throats defined by the ports $14^2$ and $16^2$ in the plate and below the valves 30 and 31.

The jets 50 are established by lateral passages 51 extending through the plates and communicating with the ports $14^2$ and $16^2$ and are provided with manually adjustable needle valve type valving members 52 to control the flow of fuel through the jets into the ports or throats. Fuel is delivered to the passages 51 through passages 23' which extend between the passages 52 and the lower open ends of the passages 53 in the central section 11.

The valve members 30 and 31 are set or adjusted so that when they are in the normal closed position, they are not fully closed, but rather, are cracked open slightly so as to allow for sufficient flow of air thereby to sustain idle operation of the engine with which the carburator is related. Such flow of air is sufficient to draw the required volume of fuel through and from the idle jets 50.

In practice, other more sophisticated means for sustaining idle operation can be provided, for example, the valve members can be normally fully closed when an idle position and the supply of idle air can be afforded by a relief or notch in the perimeter of the valve members or by small air metering openings or apertures in said valve members.

In operation, when the engine with which my invention is related is in idle operation, the valves 30, 31 and 37 are in their closed position as shown in FIGS. 1 and 2 of the drawings and the means S is in that position shown in FIG. 4 of the drawings. The engine idles on all eight of its cylinders.

When it is desired to operate the engine at increased speeds, the throttle valves 30 and 31 are open, as shown in FIG. 4 of the drawings, by the means O. The engine continues to operate on all eight cylinders and is supplied with fuel and air through both throats 14 and 16.

When it is desired to operate the engine on only four cylinders, the throat valve 31 is urged to its normal closed position and the air valve 37 is urged from its normal closed position to its open position, as shown in FIG. 5 of the drawings, by the means S. When the valves are thus positioned, fuel and air continues to flow through the throat 14 to cylinders 1, 3, 5 and 7, all but an idling volume of fuel and air are conducted through throat 16 and a full and free flow of air is established through the throat 17 and conducted to the cylinders 2, 4, 6 and 8. Accordingly, cylinders 2, 4, 6 and 8 are taken out of effective service and the engine continues to operate on cylinders 1, 3, 5 and 7 alone.

It is to be particularly noted that when the air valve 37 is open and valve 31 is closed, as noted above, an abundance of free air is supplied to cylinders 2, 4, 6 and 8 and the intake on the intake stroke of the cylinders and little or no adverse working load is placed on the engine, as would result by simply shutting off all the flow to those cylinders. It will also be apparent that when the engine is operating in the above manner, the small or limited volume of idling fuel that mixes with the air conducted to cylinders 2, 4, 6 and 8 establishes an extremely lean combustible mixture which is sufficient to fire and maintain the cylinders clean, but is not so rich as would result in the generating of excess heat, as is generated when the fuel and air mixture delivered to an engine is on the lean side. In other words, the fuel and air mixture which is delivered to the out of service engines is much too lean to establish or maintain regular and normal combustion sufficient to effect operation of the engine and to generate excess of heat, but is sufficient to assure adequate combustion for maintaining the cylinders clean and unfouled.

It will be apparent from the foregoing that with the novel throttle valve plate unit and operating means S that I provide an eight cylinder engine provided with a four barrel carburator and a compatible intake manifold can be selectively made to effectively and efficiently operate on all eight or on only four of its cylinders, as desired, or as circumstances require by simply substituting my new throttle valve plate 12 with the operating means S related to it, for the standard throttle valve plate of the carburator.

Having described only a typical preferred form and application of my invention, I do not wish to be limited to specific details herein set forth, but wish to reserve to myself any modifications and/or variations that may appear to those skilled in the art and which fall within the scope of the following claims:

Having described my invention, I claim:

1. In combination a multi-cylinder internal combusion engine with an intake manifold with two related sets of tunnels, each set of tunnels communicating with one half of the cylinders and each having a common upwardly opening inlet end, said carburator releasably secured to the manifold and having two elongate vertically extending venturi throats, each having a lower end communicating with the inlet end of one set of tunnels in the manifold, an air conducting throat communicating with one of said sets of tunnels, throttle valve members in the lower portions of the venturi throats and a shut-off valve member in the air conducting throat, fuel dispensing idle jets in the venturi throats below the throttle valve members and fuel dispensing high speed jets in the venturi throats above the throttle valve members, fuel delivery means to deliver fuel to the jets, manually operable selector means to selectively move the shut-off valve member between open and closed positions and to hold the one throttle valve member in the venturi throat communicating with said one set of tunnels in a closed position when the shut-off valve member is in an open position and manually operable throttle valve operating means to synchronously shift the throttle valve members between open and closed positions when said one throttle valve member is not held closed and to shift the other throttle valve member between open and closed positions when said one throttle valve member is held closed.

2. The structure set forth in claim 1 wherein the operating means is in direct driving engagement with said other throttle valve member and said one throttle valve member is drivingly coupled with said operating means by resilient coupling, means said selector means being shiftable into and out of driving engagement with said one throttle valve member and biasing the spring coupling when shifted to close said one throttle valve member.

3. The structure set forth in claim 1 wherein said other throttle valve member is a butterfly valve member on an inner shaft extending through and projecting from sides of the carburator, said one throttle valve member is a butterfly valve member on a tubular outer shaft engaged about a portion of the inner shaft and projecting from a side of the carburator, said operating means comprising lever and link means connected with an end of the inner shaft and operable to rotate that shaft and resilient torsional coupling means between the inner and outer shafts, said shut-off valve member being a butterfly valve on an operating shaft rotatably engaged through and projecting from the carburator, said selector means includes first and second lever arms on the operating shaft and outer shaft, an elongate axially reciprocal rod with a portion coupled to the first lever arm and carrying a stop shiftable into and out of driving engagement with the second lever arm and drive means to selectively reciprocate the rod axially.

4. In combination, an eight cylinder reciprocating internal combusion engine, an intake manifold with first and second sets of four tunnels, each set conducting fuel and air to four of the cylinders of the engine and each set having a common upwardly opening inlet end, a carburator mounted on the manifold and having first and second elongate vertically extending and opening venturi throats communicating with the inlet end of the first and second set of tunnels, respectively, an elongate vertically extending and opening air throat communicating with the inlet end of the second set of tunnels, first and second butterfly throttle valves in the first and second venturi throats and pivotally carried by first and second shafts extending through and projecting outward from the carburator, idle and high speed fuel metering jets communicating with the venturi throats above and below the throttle valves, and fuel delivery means delivering fuel to the jets, a butterfly shut-off valve in the air throat and pivotally carried by an operating shaft extending through and projecting outwardly from the carburator, throttle valve operating means including manually operable link and lever means drivingly engaging an end of said first shaft and operable to open and close the first throttle valve and a yieldable torsion spring drive coupling between the first and second shafts, selector means connected with the operating shaft and coupled with that shaft to selectively open and close the shut-off valve and to hold the second throttle valve closed against the resistance of the coupling when the shut-off valve is open.

5. The structure set forth in claim 4 wherein the selector means comprises first and second lever arms projecting radially from the ends of the operating and second shafts, an elongate reciprocating rod extending between and occurring adjacent to the first and second lever arms, means pivotally connecting the rod with the first lever arm and a stop on the rod, said stop being spaced from the second lever arm when the rod is moved in one direction to position the shut-off valve is in its closed position and in driving engagement with the second lever arm to move the second throttle valve to a closed position when the rod is moved in the other direction and moves the shut-off valve to its open position.

6. The structure set forth in claim 5 wherein said valves are carried by a plate-like section of the carburator and has ports which define the lower end portions and lower open ends of the throats.

* * * * *